United States Patent [19]

Andrus et al.

[11] 4,051,705

[45] Oct. 4, 1977

[54] DIE STEM HEATING

[75] Inventors: Paul W. Andrus, Cambridge, Mass.; Ronald A. Carter, Levittown, Pa.

[73] Assignee: Western Electric Co., New York, N.Y.

[21] Appl. No.: 699,395

[22] Filed: June 24, 1976

[51] Int. Cl.[2] ..... B21D 22/10

[52] U.S. Cl. ..... 72/60; 72/271; 72/41; 72/342; 72/DIG. 12

[58] Field of Search ..... 72/60, 342, 270, DIG. 12, 72/271, DIG. 31, 41, 257, 43; 219/424

[56] References Cited

U.S. PATENT DOCUMENTS

| | | | |
|---|---|---|---|
| 2,225,424 | 12/1940 | Schwarzkopf | 72/271 X |
| 3,060,302 | 10/1962 | Maccaferri | 219/424 |
| 3,161,756 | 12/1964 | Haverkamp et al. | 219/424 |
| 3,731,509 | 5/1973 | Fuchs, Jr. | 72/60 |
| 3,740,985 | 6/1973 | Fuchs, Jr. | 72/60 |

*Primary Examiner*—Leon Gilden
*Attorney, Agent, or Firm*—A. S. Rosen

[57] ABSTRACT

A high pressure apparatus for reducing metal rod to wire in one pass through a die by surrounding the rod with a medium under high hydrostatic pressure to maintain ductility of the metal to be formed; the die is supported against a frame member by a die stem having a central opening through which the wire passes to a winding reel. To prevent clogging of the die stem with pressure medium that passes through the die in small quantities, the die stem is heated to a temperature substantially above the softening temperature of the pressure medium.

9 Claims, 5 Drawing Figures

DIE STEM HEATING

FIELD OF THE INVENTION

The present invention relates to high pressure ductile forming and more particularly to preventing the pressure medium from clogging the outlet of the ductile forming apparatus.

BACKGROUND OF THE INVENTION

It is well known that certain metals can experience far greater ductile deformation than expected in a single pass through a die if the metal to be reduced is maintained at a high hydrostatic pressure. A machine developed specifically to cold extrude metal or deform the metal under conditions of high hydrostatic stress is shown and described in U.S. Pat. No. 3,740,985, granted on June 26, 1973, to F. J. Fuchs. The machine disclosed in the Fuchs patent uses hydrodynamic friction to build the requisite pressure by surrounding the metal (to be extruded) with a pressure medium, some of which inevitably passes in minute quantities through the die along with the material being reduced.

The pressure media used (beeswax, polyethylene wax, etc.) are generally considered to be relatively solid at room temperature and atmospheric pressure. However, these media are sometimes referred to as Bingham solids, plastics, or fluids since they exhibit the measurable yield stress of a solid, and they plastically yield with the measurable viscosity of a liquid. They are thus workable as a viscous liquid at room temperature and high hydrostatic pressure when pressurizing the metal being extruded. This room-temperature pressure medium, as it leaves the die in minute quantities along with the wire, suddenly encounters atmospheric pressure and is in almost a solid state. The very high reaction force of the extrusion die is resisted by a tubular die stem, which is a hollow tube that extends from the die to the frame of the machine. The extruded wire passes through the central aperture of the die stem. The solidified pressure medium has a tendency to clog the central aperture of the die stem. This is particularly troublesome when beginning the reduction of a new batch of metal since the beginning of the reduced metal that is to be wound onto a reel encounters this solid pressure medium and is blocked thereby.

SUMMARY OF THE INVENTION

In accordance with the present invention, the clogging of the die stem with pressure medium is prevented by heating the die stem to a temperature substantially above the softening temperature of the pressure medium.

BRIEF DESCRIPTION OF THE DRAWINGS

A more complete understanding of the present invention may be had by referring to the following detailed description when considered in conjunction with the accompanying drawings wherein the same reference number indicates the same or similar parts throughout the several views in which.

DETAILED DESCRIPTION

Figure 1:
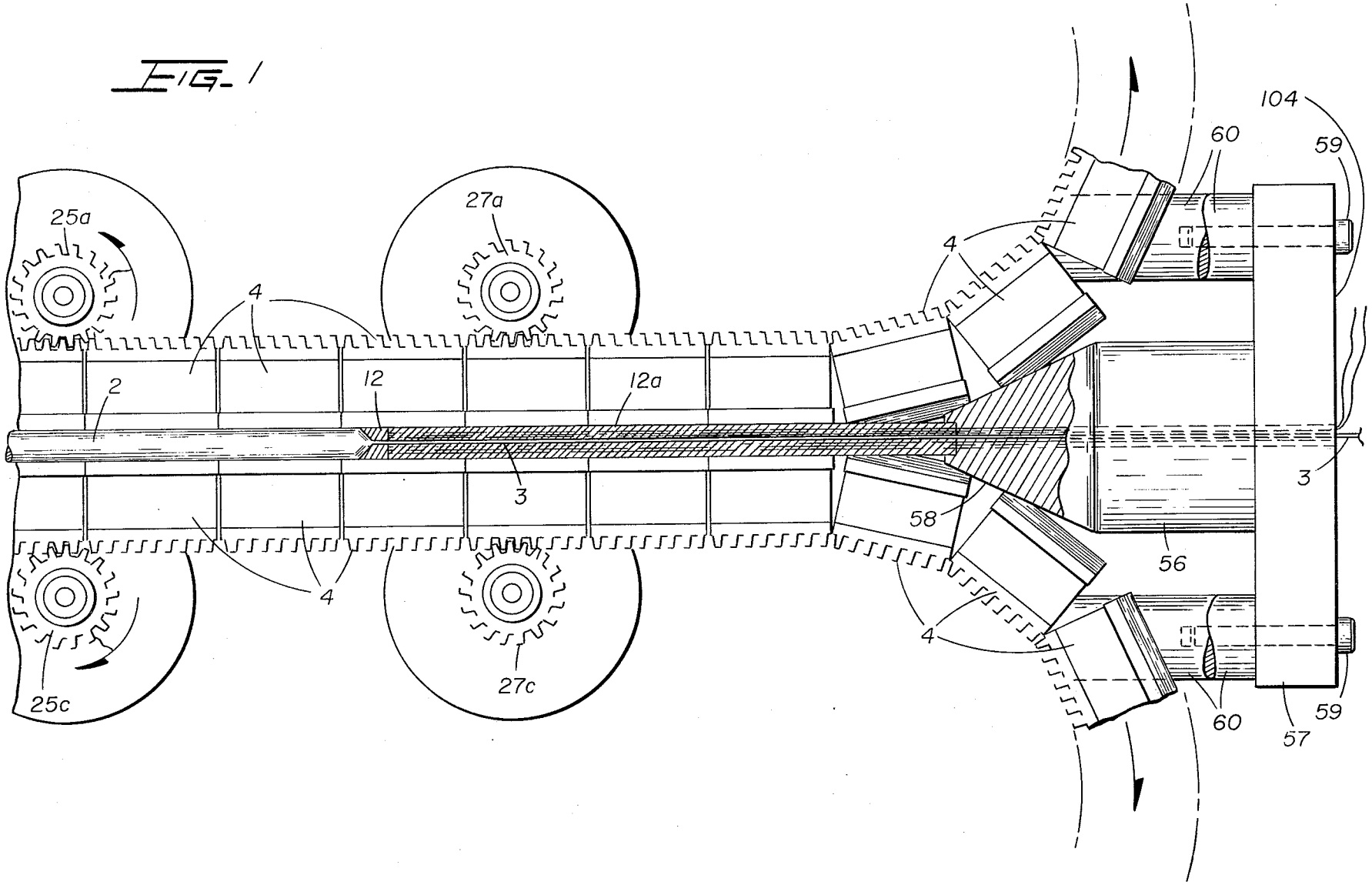
FIG. 1 is a fragmentary, cross-sectional view of the exit end of a high-pressure ductile forming machine showing the environment for the present invention.

Referring now to the accompanying drawings and more particularly to FIG. 1, there is shown a cross-sectional view of the exit end of the continuous extrusion apparatus disclosed in the above-mentioned Fuch patent. However, the die stem that supports the die has been modified to include the present invention. Wherever possible reference numbers from the above-mentioned Fuchs patent, which is incorporated herein by reference, have been used in order to facilitate the understanding and application of the present invention in the machine disclosed in the Fuchs patent.

The essential purpose of the Fuchs patent is to take a large diameter metal rod 2 of copper or aluminum, typically 5/16 inch in diameter and reduce this rod in a single pass through a reducing die to a wire 3 having a typical diameter of about 0.020 inch. Such a severe, ductile size reduction is accomplished by surrounding the rod with a pressure medium, for example, beeswax or polyethylene was under an extremely high hydrostatic pressure on the order of 150,000 to 250,000 psi.

In the operation of the Fuchs machine, the rod 2 is moved into engagement with the die, and the hydrostatic forces are applied to the pressure medium by four trains of gripping element quadrants 4 which are driven from left to right in FIG. 1. The movement of the gripping quadrants 4 frictionally drags the pressure medium with them to build up the hydrostatic pressure and by hydrodynamic friction drags the rod 2 as well. The rod 2 engages the tapered entry of an extrusion die 12 which contains a central aperture of substantially the desired wire size. The metal of the rod is thus extruded down to the diameter of the wire. The tremendous extrusion forces that are applied from left to right in FIG. 1 against the die are resisted by a die stem 12*a*.

The gripping element quadrants 4 are driven from left to right by drive mechanisms represented by pinion gears 25*a* and 25*c* which rotate in a direction indicated by the associated arrows. The gripping quadrants 4 to the left of the die 12 in FIG. 1 apply considerable force to the pressure medium. However, the quadrants 4 to the right of the die 12 in FIG. 1 have passed the work station and thus any energy they may possess should be recovered by energy-absorbing means represented by pinion gears 27*a* and 27*c* that mesh with the gripping quadrants 4.

The die stem 12*a* is held in position by a die stem support 56 that is mounted on a support plate 57. The die stem support has a tapered nose 58 in which the die stem 12a is nested. The support plate 57 is held to the framework (not shown) of the machine by a plurality of bolts 59. The bolts 59 pass through a plurality of spacers 60 that position the support plate 57 a predetermined distance from the frame of the machine.

The die stem 12*a* is under considerable axial compressive stress. Therefore, for purposes of strength, the die stem 12*a* is preferably made of tungsten carbide.

The pressure medium surrounding the rod 2 is used not only to apply hydrostatic pressure to the rod and to push the rod 2 into the die 12 but also to lubricate the die 12 as the metal of the rod 2 is deformed by the tapered entry surface of the die 12. Therefore, minute quantities of the pressure medium pass through the center of the tungsten carbide die stem 12*a*.

Under high hydrostatic stress that exceeds the yield stress of the pressure medium, the pressure medium reacts as a viscous fluid for practical purposes to pressurize and convey the rod 2. However, in the area of the die 12, the extensive deformation of the metal rod tends to heat the rod 2 and the die 12 and with them the adjacent pressure medium that passes in minute quantities through the die as a lubricant. In the room temperature, atmospheric-pressure environment inside the die stem 12*a* the pressure medium quickly cools to room temperature and becomes rather solid and can cause jamming of the extruded wire, particularly during the start-up portion of a machine cycle with a fresh rod 2. Therefore, the die stem 12*a* is formed with a slightly larger inside diameter so as to accommodate a heater and an inner guide tube to guide the extruded wire from the exit of the die to the exit of the support plate 57.

Figure 2:
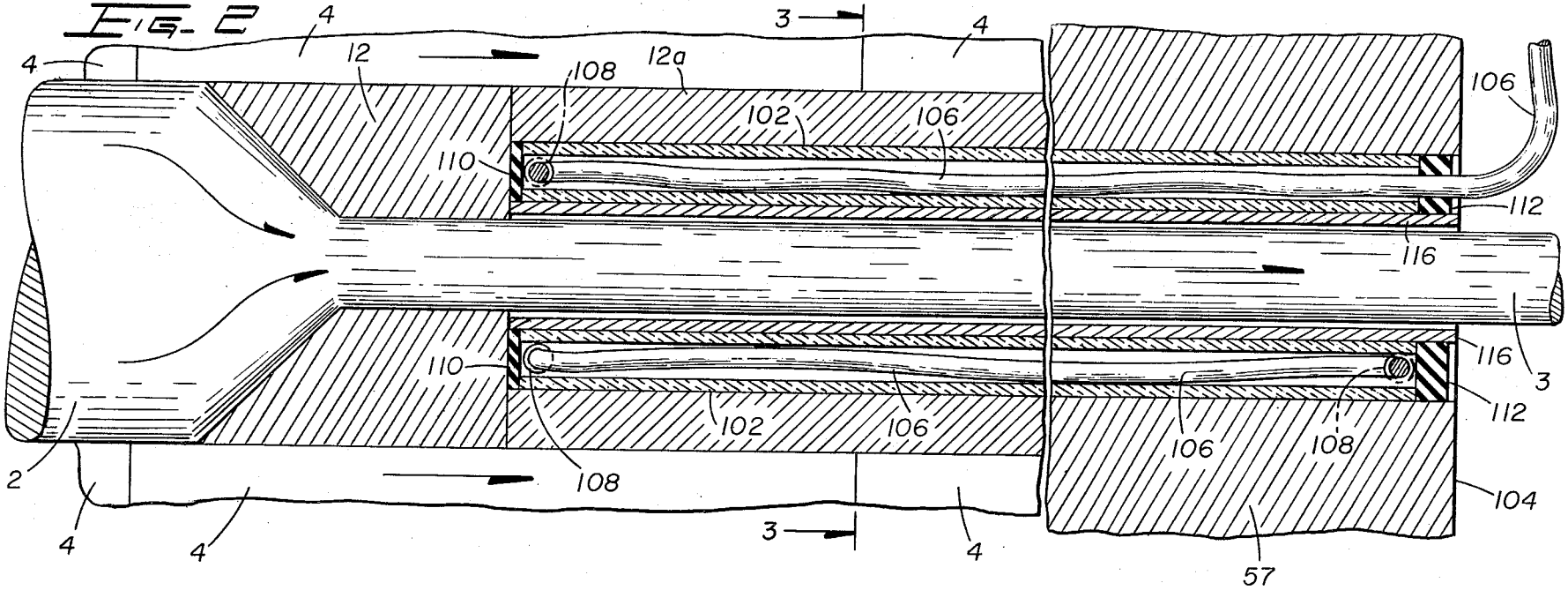
FIG. 2 is a greatly enlarged fragmentary view of the die stem of the apparatus of FIG. 1.
Figure 3:
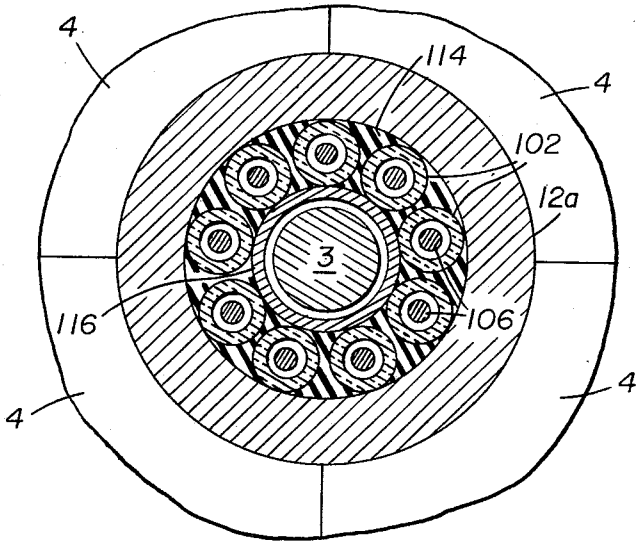
FIG. 3 is a cross-sectional view of the die stem taken along line 3—3 of FIG. 2.

Referring now to FIGS. 2 and 3 of the accompanying drawings, there is shown one embodiment of the improved die stem 12*a*. The inside diameter of the Tungsten carbide die stem 12*a* is enlarged to about one-eighth of an inch. The appropriate apertures in the die stem support 56 and the support plate 57 are also increased, in order to accommodate a heater structure shown in detail in FIGS. 2 and 3.

A plurality of alumina (aluminum oxide) tubes 102 are placed around the inside surface of the die stem 12*a* and its supporting structure. These alumina tubes are each approximately 0.020-inch inside diameter (I. D.) and approximately 0.031-inch outside diameter (O. D.), and the tubes are as long as necessary to extend from almost the die 12 to the outside surface 104 of the support plate 57. A resistance heater wire 106, preferably of Ni-Crome, is threaded through the alumina tubes 102 in series by passing through an opening 108 in one tube and into the corresponding opening 108 in the adjacent tube. The alumina tubes 102 provide electrical insulation but reasonable thermal conduction for the heater wire 106.

While the Ni-Crome wire, which is preferably of approximately 25 gauge (0.018-inch), is shown in FIG. 2 as being threaded back and forth through the alumina tubes, it is possible to arrange the lengths of Ni-Crome wire electrically in parallel and to ground one end of each wire to the die 12.

However, when the Ni-Crome wire is threaded in series as shown in FIG. 2, one or more insulators 110 are used to isolate the inner end of each individual length of the Ni-Crome wire 106 from the die 12. Additionally, one or more insulators 112 cover the outer ends of the alumina tubes 102 in order to prevent inadvertent contact with the electrically live wire 106. The insulators 112 are perforated where necessary to provide access for the wire 106. As shown best in FIG. 3, an electrically insulating but thermally conductive binder or potting compound 114 is placed in the interstices between the alumina tubes 102.

A stainless steel guide tube 116 provides the inner surface of the heater structure illustrated in FIGS. 2 and 3 and preferably has an 0.008-inch wall thickness and a 0.050-inch inside diameter to accommodate extruded wire of various diameters. The guide tube 116 extends all the way from the die 12 to the outside surface 104 and provides a guiding surface for the wire 3.

The pressure medium that is frictionally dragged along with the rod 2 into the die 12 lubricates the die and immediately melts as it reaches the heated guide tube 116. The melted pressure medium is then pulled out of the end of the guide tube 116 by the moving wire 3 and flows onto the outside surface 104 preferably to be collected by recycling.

The Ni-Crome wire 106 is insulated from the wire 3 and the die 12 in order to prevent shorting of the Ni-Crome and thus impairing its heating capability. However, if a parallel connection of the Ni-Crome segments in each alumina tube is used, only the end of the Ni-Crome near the outside surface 104 need be insulated. Contact between the parallel-connected segments of the Ni-Crome wire and the die is then actually desired in order to complete the electrical heater circuit through the grounded frame of the machine.

Figure 4:
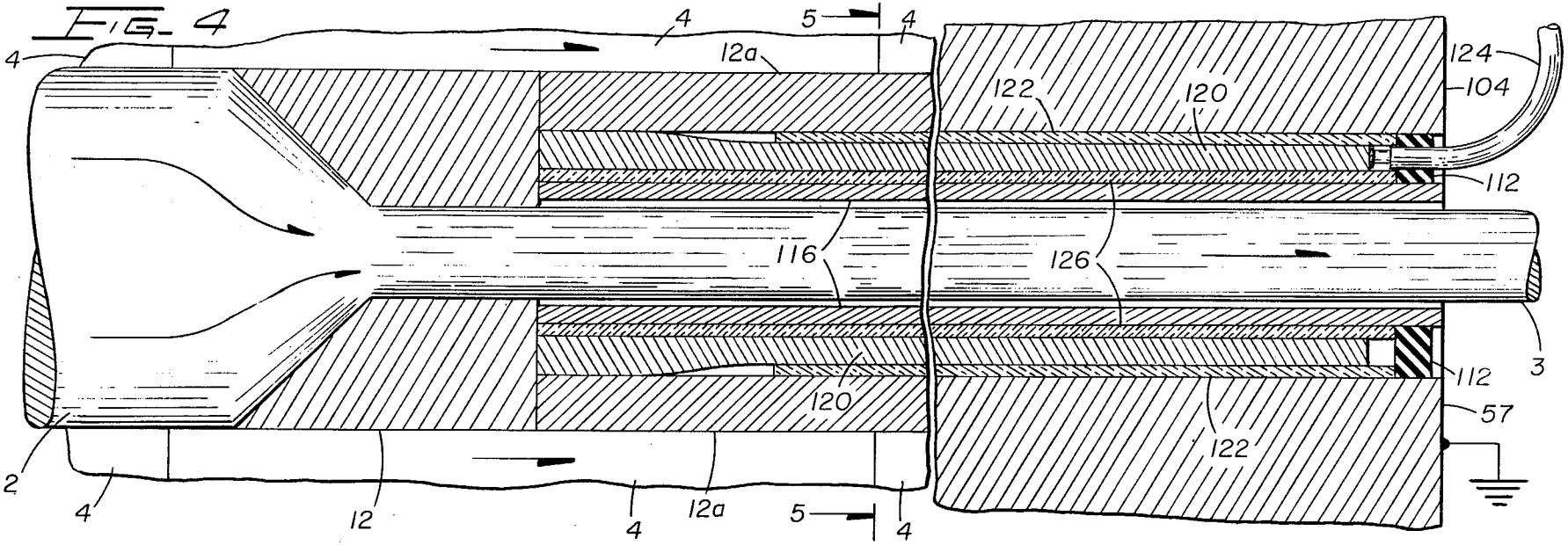
FIG. 4 is greatly enlarged fragmentary view of an alternative embodiment of the die stem of the apparatus of FIG. 1.
Figure 5:
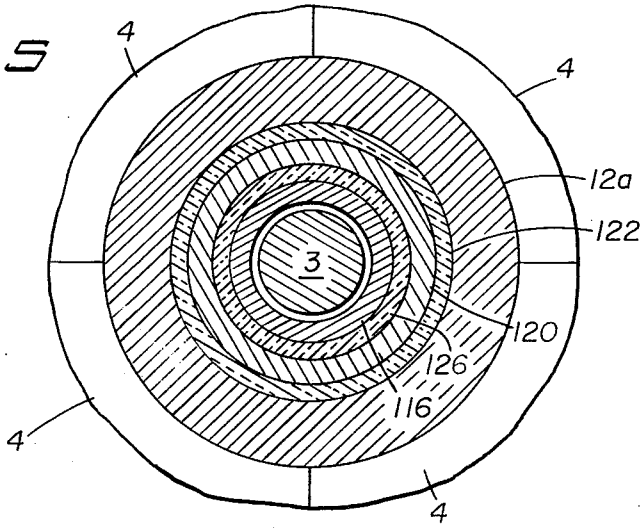
FIG. 5 is a cross-sectional view of the alternative die stem taken along line 5—5 in FIG. 4.

Referring now to FIGS. 4 and 5 of the accompanying drawings, an alternative embodiment is shown which may have the advantage of simpler and more robust construction over that illustrated in FIGS. 2 and 3. In FIG. 4, a stainless steel tube 120 is used as the resistive heating element and extends from the die 12 to nearly the outside surface 104. The heater tube 120 is electrically insulated from the die stem 12*a* and the support structure of the die stem by an alumina cylinder 122 that extends between the stainless steel tube 120 and the die stem 12*a* or its support structure from nearly the outside surface 104 nearly to the die 12. A gap exists in the alumina cylinder 122 between the end of the alumina cylinder 122 and the die 12. The outside diameter of the steel tube 120 is enlarged near the die 12 so as to promote electrical contact with the die 12 and the die stem 12*a*. This establishes an electrical circuit connection between a power supply wire 124, through the steel heater tube 120, and the return through the structure of the machine.

An inner alumina tube 126 electrically insulates but thermally conducts between the steel tube 120 and the guide tube 116. An insulator 112 prevents inadvertent contact with the live end of the steel tube 120 except by the power supply wire 124. Therefore, the heat generated by electrical current passing through the steel tube 120 is conducted through the inner alumina tube 126 to the guide tube 116.

Although particular embodiments of the invention are shown in the drawings and have been described in the foregoing specification, it is to be understood that other modifications of this invention, varied to fit particular operating conditions will be apparent to those skilled in the art; and the invention is not to be considered limited to the embodiments chosen for purposes of disclosure, and cover all changes and modification which do not constitute departures from the true scope of the invention.

What is claimed is:

1. A method of extruding an elongated, metallic workpiece through an aperture in a die, which die is supported at an exit end thereof by an apertured die stem, so as to form an elongated, metallic product, the method comprising the steps of:

a. continuously advancing a heat-softenable pressure medium toward an entrance end of said die aperture, while applying the advancing medium to the periphery of said elongated, metallic workpiece, such that frictional drag forces transmitted by the advancing medium along said periphery cause the elongated, metallic workpiece to pass through the die aperture and then into said apertured die stem as said elongated, metallic product, surrounded by at least a portion of the medium; while b. applying sufficient heat from a source of electrical energy, circumferentially about the periphery of the apertured die stem, to so regulate the temperature of the medium passing with the elongated, metallic product into the apertured die stem as to maintain the medium within the apertured disc stem continuously in a softened state, capable of flowing freely through the apertured die stem with the advancing, elongated, metallic product; and while c. electrically isolating the apertured die stem from said source of electrical energy.

2. A method as set forth in claim 1, wherein said step (b) further comprises:

d. applying said heat along substantially the entire length of the apertured die stem.

3. Apparatus for so deforming an elongated, metallic workpiece as to produce an elongated, metallic product, the apparatus comprising:

a die having an aperture extending therethrough from an entrance end to an exit end thereof;

a die stem supporting the die at said exit end thereof and having an aperture extending therethrough, said die stem aperture being aligned with said die aperture;

means for continuously advancing a heat-softenable pressure medium toward said entrance end of the die aperture, while applying the advancing medium to the periphery of the elongated, metallic workpiece, such that frictional drag forces transmitted by the advancing medium along said periphery cause the elongated, metallic workpiece to pass through said die aperture and then into said die stem aperture as said elongated, metallic product, surrounded by at least a portion of the medium;

means, circumferentially surrounding said die stem aperture, for applying sufficient heat from a source of electrical energy to said die stem to so regulate the temperature of the medium passing with the elongated, metallic product into the die stem aperture as to maintain the medium within the die stem aperture continuously in a softened state, capable of flowing freely through the die stem aperture with the advancing, elongated, metallic product; and means for electrically isolating the die stem from said source of electrical energy.

4. Apparatus as set forth in claim 3, wherein said heat applying means further comprises:

means for applying said heat substantially along the entire length of said die stem.

5. An apparatus according to claim 4 wherein the means for heating the die stem comprises:

an electrical resistance element surrounding the die stem.

6. An apparatus according to claim 5 wherein the electrical resistance element comprises a steel tube concentric with the die stem and through which an electric current is passed.

7. An apparatus according to claim 6 wherein the steel tube is electrically insulated from the die stem by a layer of aluminum oxide separating the steel tube from the die stem.

8. An apparatus according to claim 4 wherein the means for heating the die stem comprise a plurality of electrical resistance heater elements arranged along the length of the die stem and spaced around the axis of the die stem.

9. An apparatus according to claim 3 further comprising a guide tube inside of the heating means for protecting the heating means from damage from the extrudate.

* * * * *